US005363018A

United States Patent [19]

Shackle

[11] Patent Number: 5,363,018

[45] Date of Patent: Nov. 8, 1994

[54] BALLAST CIRCUIT EQUIPPED WITH GROUND FAULT DETECTOR

[75] Inventor: Peter W. Shackle, Arlington Heights, Ill.

[73] Assignee: Motorola Lighting, Inc., Buffalo Grove, Ill.

[21] Appl. No.: 122,824

[22] Filed: Sep. 16, 1993

[51] Int. Cl.[5] ..... H05B 37/00

[52] U.S. Cl. ..... 315/127; 315/219; 315/224; 315/DIG. 5; 315/DIG. 7

[58] Field of Search ..... 315/127, 205, 219, 224, 315/DIG. 5, DIG. 7

[56] References Cited

U.S. PATENT DOCUMENTS 4,939,427 7/1990 Nilssen ..... 315/209 R
5,041,766 8/1991 Fiene et al. ..... 315/219
5,049,787 9/1991 Nilssen ..... 315/224

*Primary Examiner*—Robert J. Pascal
*Assistant Examiner*—Darius Gambino
*Attorney, Agent, or Firm*—Wayne J. Egan

[57] ABSTRACT

A ballast circuit (100) includes a ground fault detector (200). The ballast circuit is arranged for coupling to a power source (101) and a load (135, 137), the power source characterized by a source frequency, the ballast circuit including an electromagnetic interference ("EMI") filter (110) which includes a ground terminal (145). The ground fault detector (200) determines when the load is coupled to a ground fault (141) by detecting the presence of a high-frequency current at the ground terminal, the high-frequency current characterized by a frequency that is substantially greater than the source frequency. When the high-frequency current is detected, the ground fault detector provides an output signal (150) which may be used to disconnect the load from the ballast circuit.

17 Claims, 1 Drawing Sheet

BALLAST CIRCUIT EQUIPPED WITH GROUND FAULT DETECTOR

Incorporation by Reference of Another U.S. Patent

The applicant hereby incorporates by reference U.S. Pat. No. 4,939,427, Ole K. Nilssen, "Ground Fault Protected Series Resonant Ballast," issued Jul. 3, 1990, verbatim and with the same effect as though the same patent were fully and completely set forth herein.

Field of the Invention

This application relates to ballast circuits including, but not limited to, ballast circuits equipped with ground fault detectors.

BACKGROUND OF THE INVENTION

Ballast circuits are known. As is known, a ballast circuit converts electrical power from a commercially-available source to a form suitable for powering a load-typically one or more discharge lamps. Such ballast circuits typically have electromagnetic interference ("EMI") filters. It is common for such EMI filters to have one or more ground terminals.

A common hazard is the load being coupled to a ground fault condition, thus presenting a path to ground. This may occur, for instance, if a human being makes electrical contact with the load. In this case, current may flow through the human being to ground, thus causing physical injury to the human being. It is known to use a ground fault detector to detect the presence of a ground fault condition and, in response, to disconnect the load from the power source. In the aboveidentified Nilssen patent, for example, the EMI filter acts to produce a control signal in case a ground-fault current were to occur, which control signal is used for preventing the magnitude of the ground-fault current from exceeding acceptable limits. See, Nilssen, col. 2, I. 1–5.

What is disclosed herein is a novel ground fault detector which may be used with any ballast circuit having an EMI filter, wherein the EMI filter includes a ground terminal distinct from the AC power line.

DESCRIPTION OF THE PREFERRED EMBODIMENT

Figure 1:
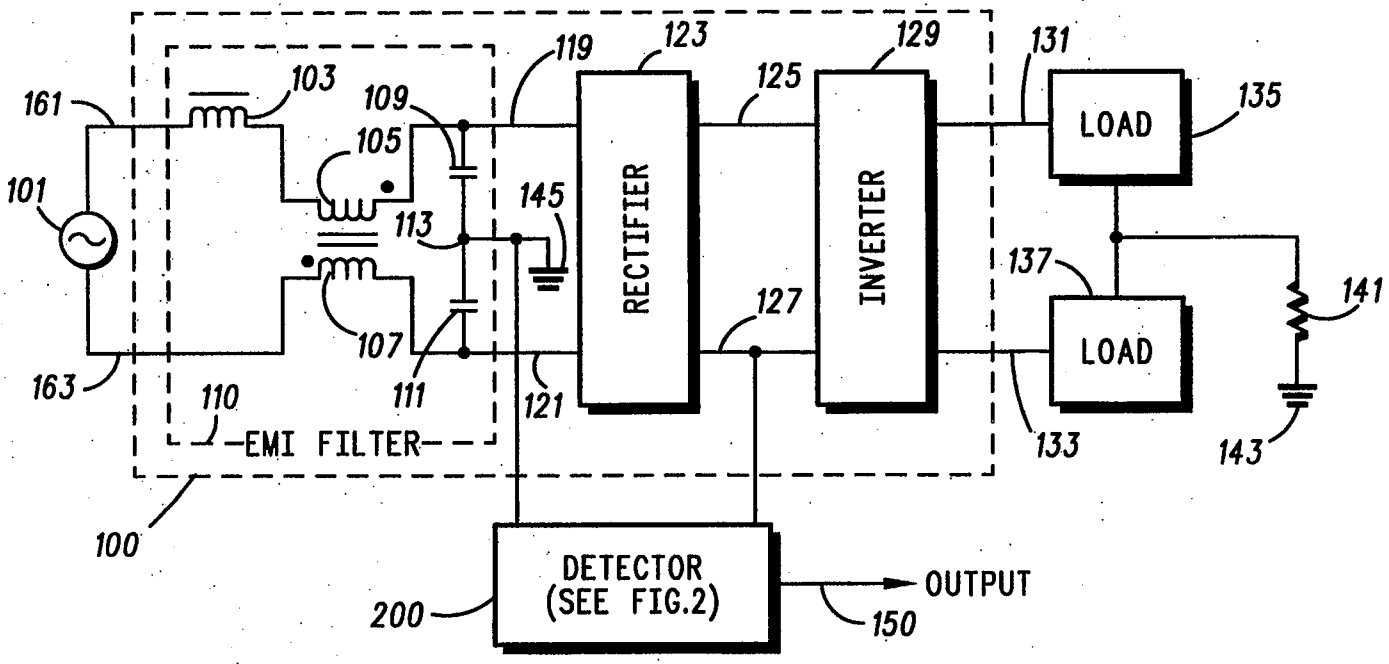
FIG. 1 is a block diagram that shows a first embodiment of a ballast circuit 100 equipped with a ground fault detector 200 in accordance with the present invention.

Referring to FIG. 1, there is shown a ballast circuit 100 arranged for coupling to an AC power source 101 and a load 135, 175. The load may comprise, for example, one or more discharge lamps. The power source may be a commercial power source having a fixed frequency such as, for example, 60 Hz. As shown, the AC power source 101 provides power to the ballast circuit 100 by means of an AC power line 161, 163.

The ballast circuit includes an EMI filter 110, a rectifier 123, and an inverter 129, the EMI filter having a filter input, filter output, and a ground terminal 145. As shown, the filter input is arranged for coupling to the power source, the filter output being coupled to the rectifier input via the leads 119, 121. The rectifier output, in turn, is coupled to the inverter input via the leads 125, 127. The inverter output, in turn, is arranged for coupling to the load via the leads 1 31, 133.

As shown, the EMI filter 110 includes a series inductor 103, a choke 105, 107, and de-coupling capacitors 109, 111, the decoupling capacitors having a common terminal 113, the common terminal 113 being connected to the ground terminal 145. While a specific EMI filter 110 has been disclosed, the teachings of the present invention are equally applicable with any EMI filter which includes a ground terminal distinct from the AC power line 161, 163.

As shown, the ballast circuit 100 is equipped with a ground fault detector 200 which is arranged for determining when a ground fault 141 is coupled between the load and ground 143. As shown, the detector 200 is coupled to the ballast circuit 100 by means of the ground terminal 145 and the lead 127, which lead 127 is a common terminal between the rectifier 123 and the inverter 129.

Briefly, in accordance with the present invention, the ground fault detector 200 determines when a high-frequency signal exists at the ground terminal 145 with respect to the common terminal 127, the high-frequency signal being characterized by a frequency that is substantially greater than the frequency of the power source 101. When the high-frequency signal is detected, the ground fault detector provides an output signal 150 which, in turn, may be used to disconnect the load 135, 137 from the ballast circuit. As a result, the ground fault 141 is disconnected from the power leads 131, 133.

Figure 2:
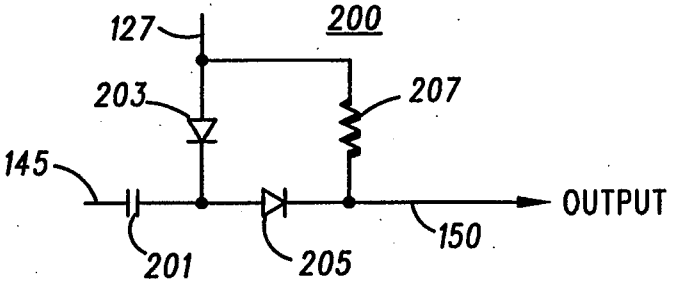
FIG. 2 shows more detail for the detector 200.

Referring to FIG. 2, it is seen the ground fault detector 200 includes a coupling capacitor 201 connected in series with the ground terminal 145, a first diode 203 connected in series with the coupling capacitor 201 and the common rectifier-inverter terminal 127, and a second diode 205 connected in series with the coupling capacitor and the ground fault detector output terminal 150.

As mentioned above, the detector 200 is arranged to provide an output at terminal 150 when a high-frequency signal is detected at the ground terminal 145 with respect to the common terminal 127, the high-frequency signal being characterized by a signal frequency that is greater than 1000 Hz, and a signal amplitude that is greater than 0.7 volts root mean squared.

A typical value for capacitor 201 is 1500 pF, with a 2,000 volt breakdown tolerance. A typical value for resistor 207 is 220 ohms. A typical part number for the diodes 203, 205 is 1 N4937, available from Motorola, Inc.

It is believed the ground fault detector 200 functions with the ballast circuit 100 as follows: When a ground fault 141 is present as shown, high-frequency current is forced to flow to the terminal 113 via the ground terminal 145. This high-frequency current produces a corresponding high-frequency voltage signal at the ground terminal 145 with respect to the common terminal 127, which high-frequency signal is rectified by the detector 200 to provide a ground fault detector output signal 150. By detecting the high-frequency voltage signal, the detector 200 thereby also detects the high-frequency current present at the ground terminal. As mentioned above, this signal 150 may be used to shut down the power from the ballast 100.

As mentioned above, it is believed a ballast circuit equipped with a ground fault detector, in accordance with the present invention, is novel with respect to the prior art. While Nilssen's EMI filter detects high-frequency current flow, it is noted that Nilssen's ground fault detector detects current flowing by way of one or both of the power input terminals PIT1, PIT2 and one or both of windings W1 and W2 of suppression inductor SI, thereby developing a corresponding voltage across auxiliary winding AW. It is further noted that Nilssen's EMI filter does not include a ground terminal distinct from his AC power line. See Nilssen, cot. 5, I. 48–66.

In contrast, the present ground fault detector 200 detects high-frequency current flowing by way of the EMI filter 110's ground terminal 145. It is further noted that the EMI filter ground terminal 145 is distinct from the AC power line 161, 163.

Thus, there is disclosed a ballast circuit 100 arranged for coupling to a power source and a load, the power source being characterized by a source frequency. The ballast circuit includes an EMI filter, a rectifier, and an inverter. The EMI filter includes a filter input, filter output, and a ground terminal. The rectifier includes a rectifier input and a rectifier output. The inverter includes an inverter input and an inverter output, the rectifier output and the inverter input having a common terminal therebetween. The filter input is arranged for coupling to the power source. The filter output is coupled to the rectifier input, and the rectifier output is coupled to the inverter input. The inverter output is arranged for coupling to the load. The ballast circuit includes a ground fault detector 200 arranged for determining when a high-frequency signal exists at the ground terminal with respect to the common terminal and for providing an output signal at an output terminal when the high-frequency signal exists. The high-frequency signal is characterized by a frequency that is substantially greater than the source frequency.

There is also disclosed a ballast circuit 100 arranged for coupling to a power source and a load, the power source being characterized by a source frequency. The ballast circuit includes an EMI filter arranged for coupling to the power source, the EMI filter having a ground terminal. The ballast circuit includes a ground fault detector 200 arranged for determining when a high-frequency current exists at the ground terminal and for determining that the load is coupled to a ground fault when the high-frequency current exists. The high-frequency current is characterized by a frequency that is substantially greater than the source frequency.

Moreover, the ground fault detector 200 may be used with any ballast circuit having an EMI filter, wherein the EMI filter includes a ground terminal distinct from the AC power line.

In summary, a ballast circuit 100 includes a ground fault detector 200. The ballast circuit is arranged for coupling to a power source 101 and a load 135, 137, the power source characterized by a source frequency, the ballast circuit including an EMI filter 110 which includes a ground terminal 145. The ground fault detector 200 determines when the load is coupled to a ground fault 141 by detecting the presence of a high-frequency signal at the ground terminal with respect to a common terminal, the high-frequency signal characterized by a frequency that is substantially greater than the source frequency, When the high-frequency signal is detected, the ground fault detector provides an output signal 150 which may be used to disconnect the load from the ballast circuit.

One advantage of a ballast circuit equipped with a ground fault detector, in accordance with the present invention, with respect to Nilssen is that the present detector 200 is connected to an alreadyavailable node in the circuit, namely ground terminal 145, without the need for placing expensive auxilliary windings on the EMI transformer 105, 107. This results in a lower manufacturing cost.

While various embodiments of a ballast circuit equipped with a ground fault detector, in accordance with the present invention, have been described hereinabove, the scope of the invention is defined by the following claims.

What is claimed is:

1. A ballast circuit arranged for coupling to a power source and a load, the power source being characterized by a source frequency, the ballast circuit including an electromagnetic interference ("EMI") filter, a rectifier, and an inverter, the EMI filter having a filter input, filter output, and a ground terminal, the rectifier having a rectifier input and a rectifier output, the inverter having an inverter input and an inverter output, the rectifier output and the inverter input having a common terminal therebetween, the filter input arranged for coupling to the power source, the filter output coupled to the rectifier input, the rectifier output coupled to the inverter input, the inverter output arranged for coupling to the load, the ballast circuit including a ground fault detector for determining when the load is connected to a ground fault, the ground fault detector including:

means for determining when a high-frequency signal exists at the ground terminal with respect to the common terminal and for providing an output signal at an output terminal when the high-frequency signal exists, where the high-frequency signal is characterized by a signal frequency that is substantially greater than the source frequency.

2. The ballast circuit of claim 1, the determining and providing means including a coupling capacitor connected in series with the ground terminal.

3. The ballast circuit of claim 2, the determining and providing means further including a first diode connected in series with the coupling capacitor and the common terminal.

4. The ballast circuit of claim 3, the determining and providing means further including a second diode connected in series with the coupling capacitor and the output terminal.

5. The ballast circuit of claim 4, wherein the source frequency is 60 Hz and the signal frequency is greater than 1000 Hz.

6. The ballast circuit of claim 5, the high-frequency signal being further characterized by a signal amplitude that is greater than 0.7 volts root mean squared.

7. The ballast circuit of claim 6, the load comprising one or more discharge lamps.

8. A ballast circuit arranged for coupling to a power source and a load, the power source being characterized by a source frequency, the ballast circuit including an electromagnetic interference ("EMI") filter, a rectifier, and an inverter, the EMI filter having a filter input, filter output, and a ground terminal, the rectifier having a rectifier input and a rectifier output, the inverter having an inverter input and an inverter output, the rectifier output and the inverter input having a common terminal therebetween, the filter input arranged for coupling to the power source, the filter output coupled to the rectifier input, the rectifier output coupled to the inverter input, the inverter output arranged for coupling to the load, the ballast circuit including a ground fault detector arranged for determining when a high-frequency signal exists at the ground terminal with respect to the common terminal and for providing an output signal at an output terminal when the high-frequency signal exists, where the high-frequency signal is characterized by a signal frequency that is substantially greater than the source frequency.

9. The ballast circuit of claim 8, the ground fault detector including a coupling capacitor connected in series with the ground terminal.

10. The ballast circuit of claim 9, the ground fault detector further including a first diode connected in series with the coupling capacitor and the common terminal.

11. The ballast circuit of claim 10, the ground fault detector further including a second diode connected in series with the coupling capacitor and the output terminal.

12. The ballast circuit of claim 11, wherein the source frequency is 60 Hz and the signal frequency is greater than 1000 Hz.

13. The ballast circuit of claim 12, the high-frequency signal being further characterized by a signal amplitude that is greater than 0.7 volts root mean squared.

14. The ballast circuit of claim 13, the load comprising one or more discharge lamps.

15. A ballast circuit arranged for coupling to a power source and a load, the power source being characterized by a source frequency, the ballast circuit including an electromagnetic interference ("EMI") filter arranged for coupling to the power source, the EMI filter having a ground terminal, the ballast circuit including a ground fault detector including means for determining when a high-frequency current exists at the ground terminal and for determining that the load is coupled to a ground fault when the high-frequency current exists, where the high-frequency current is characterized by a current frequency that is substantially greater than the source frequency.

16. The ballast circuit of claim 15, wherein the source frequency is 60 Hz and the current frequency is greater than 1000 Hz.

17. The ballast circuit of claim 16, the load comprising one or more discharge lamps.

* * * * *